United States Patent [19]

Vanhille

[11] Patent Number: 4,682,485

[45] Date of Patent: Jul. 28, 1987

[54] METHOD OF FORMING A CYLINDRICAL SLEEVE

[75] Inventor: André A. F. L. Vanhille, Boechout, Belgium

[73] Assignee: Sobemi N.V., Lint, Belgium

[21] Appl. No.: 660,883

[22] Filed: Oct. 15, 1984

[30] Foreign Application Priority Data

Oct. 20, 1983 [NL] Netherlands ..... 8303615

[51] Int. Cl.[4] ..... B21D 11/00; B21D 51/00

[52] U.S. Cl. ..... 72/133; 72/166

[58] Field of Search ..... 72/129, 130, 131, 132, 72/133, 134, 368, 166

[56] References Cited

U.S. PATENT DOCUMENTS

| | | | |
|---|---|---|---|
| 735,936 | 8/1903 | Blakey et al. | 72/166 X |
| 1,936,454 | 11/1933 | Klocke | 72/133 |
| 2,223,599 | 12/1940 | Cameron | 72/133 X |
| 2,245,407 | 6/1941 | Lignian | 72/134 |
| 2,413,594 | 12/1946 | White | 72/133 |
| 3,959,066 | 5/1976 | Miller et al. | 72/133 X |

FOREIGN PATENT DOCUMENTS

| | | | |
|---|---|---|---|
| 2482 | of 1853 | United Kingdom | 72/133 |

*Primary Examiner*—E. Michael Combs

*Attorney, Agent, or Firm*—John P. Snyder

[57] ABSTRACT

A method of forming a sleeve of circular cross-section from a flat plate of predetermined shape is provided by which in a very simple, reliable and cheap manner a sleeve can be manufactured, the shape of which corresponds with a desired shape without an additional pre- or post process.

In order to achieve the objects mentioned above a method as mentioned is provided in which the plate is pressed through a shaft enclosing the plate against and along a hollow mould wall having a shape corresponding to the shape of the sleeve to be made.

Furthermore a device for carrying out the aforesaid method is provided characterized by a gap-shaped shaft, the width of which is smaller than twice the thickness of the plate, the outlet end of said shaft adjoining a fixed, hollow mould wall having a shape matching the shape of the sleeve to be manufactured, while at the inlet end it co-operates with means for pressing the plate through the shaft.

9 Claims, 4 Drawing Figures

FIG. 1
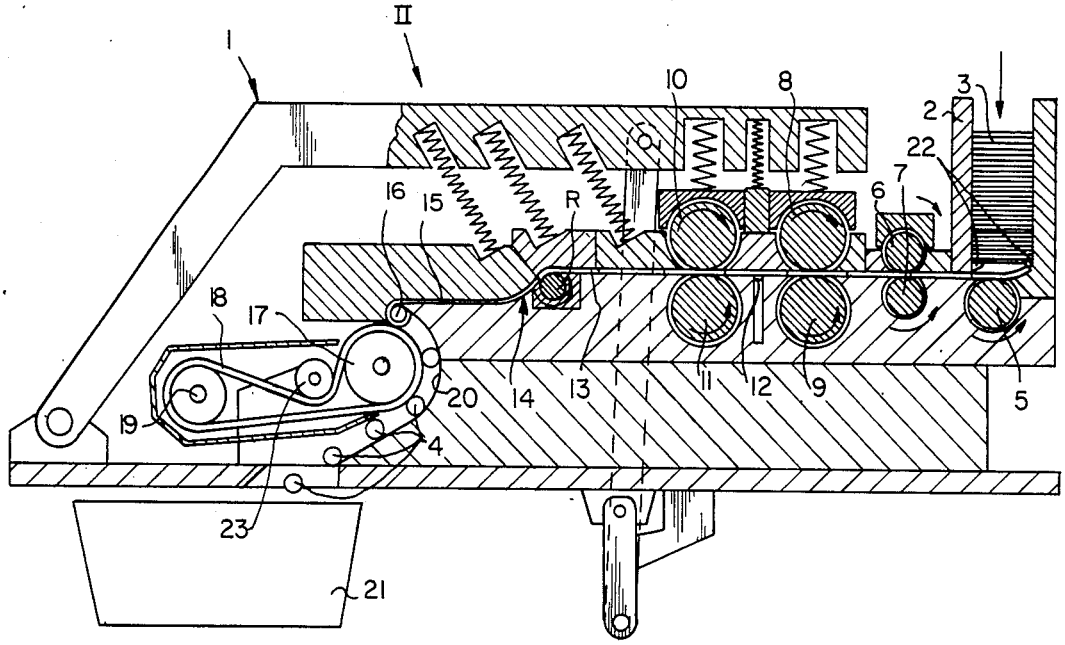
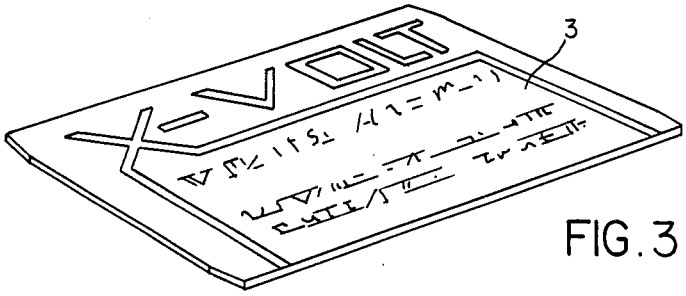
FIG. 3
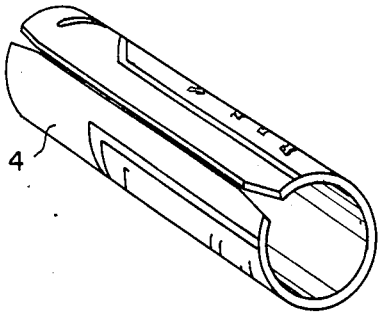
FIG. 4

METHOD OF FORMING A CYLINDRICAL SLEEVE

The invention relates to a method of forming a sleeve of circular cross-section from a flat plate of predetermined shape.

Such a method is known. The formed sleeves may be envelopes for batteries.

In prior art manufacturing sleeves it cannot have avoided that at least one of the sides of the proximal edges has a flat part. This would require a special preliminary operation or a plurality of steps.

A further problem of the prior art is that usually devices operating in reciprocatory movements are used, which determine the upper limit of the production rate.

The invention has for its object to provide a method by which in a very simple, reliable and cheap manner a sleeve can be manufactured, the shape of which corresponds with a desired shape without an additional pre- or post-process.

The invention has furthermore for its object to carry out the method so that a device for carrying out said method does not comprise reciprocating parts.

In order to achieve the objects mentioned above the invention provides a method of the kind set forth in the preamble in which the plate is pressed through a shaft enclosing the plate against and along a hollow mould wall having a shape corresponding to the shape of the sleeve to be made.

The invention furthermore provides a device for carrying out such a method, said device being characterized by a gap-shaped shaft, the width of which is smaller than twice the thickness of the plate, the outlet end of said shaft adjoining a fixed, hollow mould wall having a shape matching the shape of the sleeve to be manufactured, whilst at the inlet end it co-operates with means for pressing the plate through the shaft. Said gap width ensures great reliability and insensitivity to disturbances because the plates cannot slide one on the other.

For forming a cylindrical sleeve a rectangular plate can be pressed against and along a cylindrical hollow mould wall.

Particularly practical is that method embodying the invention in which the plate to be deformed is pressed by a next-following plate out of the shaft against the mould wall. This design, which is preferred, provides a fully continuous process to form sleeves obtained in an uninterrupted sequence from a row of plates one pushing on the other towards, against and along the mould wall. This complete continuity ensures a very slight mechanical load of the mould wall, which therefore has an extremely long lifetime. The mould wall is not repeatedly loaded shockwise, but it is loaded substantially fully continuously so that owing to this substantially stationary load wear will be gradual and not concentrated at the place of entry.

It will be obvious that it is of paramount importance for the state of deformation of the plate under the action of the mould wall to be the same throughout the surface of the plate. In practice it appears that sheet material does not always exhibit the homogeneous properties required for this purpose. In order to be less dependent on the quality of the sheet material supplied and to ensure at all times a high-quality product it is preferred to use a method in which the plate is first passed through a station improving the homogeneity of the physical properties of the sheet material. Such a station is designed to bend the plates at least once in one direction and subsequently in the other direction.

In this case the rectangular plate can be pressed against and along a hollow mould wall which is at most semi-cylindrical. This method has the advantage that no lateral expulsion of a formed sleeve from the hollow mould wall is necessary, since, for example, by gravity, the formed sleeves can be conducted away in the direction of the deformation.

Owing to the simplicity of the device the method embodying the invention requires little power for manufacturing a sleeve. Moreover, with respect to the disposition of the various component parts and to the guidance of the plates to be deformed the construction of the device is considerably simpler.

The invention will now be described with reference to a drawing. Herein

FIG. 1 is a drastically simplified cross-sectional view of an embodiment of a device in accordance with the invention, FIG. 2 shows a detail II of FIG. 1, FIG. 3 shows a plate to be deformed and FIG. 4 shows a sleeve formed by passing the plate of FIG. 3 through the device of FIGS. 1 and 2.

FIG. 1 shows a device 1 to form sleeves 4 from plates 3 contained in a stock holder 2. In the area of a roller 5 the plates 3 are removed from the stack of plates 3 in the holder 2 by means operating by subatmospheric pressure. The lowermost plate is carried at its edges by ridges 22. From this place they are transported further by transport rollers 6, 7 towards pairs of rollers 8, 9 and 10, 11 respectively, the centre-to-centre distance of which is slightly smaller than two lengths of the plates, i.e. the linear dimension of the plates in the transport direction. Due to the absence of lateral guidance beyond the rollers 8, 9 the required accuracy in positioning the plates is not ensured at the start of the device. Between the pairs of rollers 8, 9 and 10, 11 is arranged a brake 12, which is a mechanical brake in the embodiment shown, but which may as well be of, for example, a magnetic or subatmospheric-pressure type. The ram 12 serves to bring a supplied plate to a full stop.

The supplied plates 3 are guided through a gap-shaped shaft 13 enclosing the plates in their plane, said shaft having, downstream, with respect to the pair of rollers 10, 11, a part 14 of generally S-shaped form. In the inlet part of this slightly S-shaped part 14 is located a roller R. The part 14 is a cracking station to improve the homogeneity of the physical properties of the sheet material.

From the cracking station, after a straight shaft part 15, each supplied plate is pressed against and along a mould wall 16 having a shape matching the shape of the sleeves to be formed. In this embodiment the mould wall is slightly less than semi-cylindrical, that is to say, it covers an angle of less than 180° in the plane of the drawing. From the drawing it will be apparent that in this way a self-detaching effect is obtained for the sleeves 4 formed. However, with regard to the extremely high rate of production attainable by a device of the type described a delivery transport roller 17 is used for accelerating the delivery. There are furthermore two freely rotating rollers i.e. a stretching roller 19 and a guide roller 23. A rope 18 passes along the rollers 17, 19 and 23. Owing to the great length of the rope 18 as compared with the circumference of the delivery transport roller 17 the rope 18 has a relatively long working life. Through a chute 20 co-operating with the transport roller 17 the sleeves 4 are supplied to a stock container 21. FIG. 2 shows in detail the S-shaped shaft part 14 and the mould wall 16.

FIG. 3 shows a plate 3 previous to the deformation.

FIG. 4 shows a battery sleeve 4 manufactured with the aid of the devices of FIGS. 1 and 2.

Figure 2:
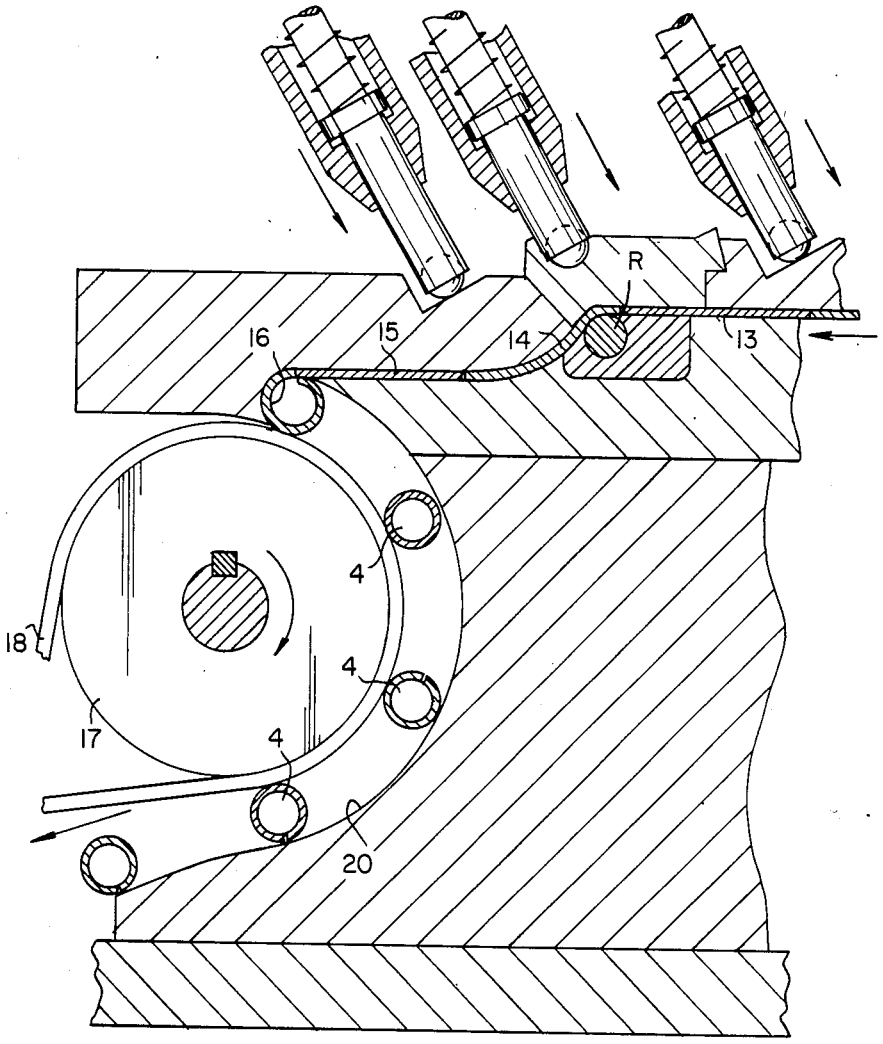

I claim:

1. The method of making a cylindrical sleeve from a plate of predetermined width, thickness and length so that the plate presents opposite side surfaces and opposite end edges, which comprises the steps of:

feeding the plate lengthwise while confined in its thickness dimension and terminating the confinement of the plate in its thickness direction while initiating deformation of the plate into final cylindrical form by progressively forcing one side surface of the emerging plate along an arcuate path of a length of at most one half the length of the plate and having a radius substantially equal to the radius of the sleeve to be formed; and continuing the feeding of the plate until the opposite end edges of the plate are in substantially contiguous relation and the cylindrical sleeve has been formed.

2. The method as defined in claim 1 including the step of deforming the plate while confined in its thickness dimension in a direction opposite to that deformation effected as the plate emerges from its thickness dimension confinement.

3. The method as defined in claim 1 including the step of effecting the feeding of said plate by successively following plates to be deformed into cylindrical shape.

4. The method of forming a plate having opposite end edges into a sleeve of cylindrical form which comprises the steps of:

feeding the plate lengthwise while confined in its thickness dimension to emerge from such confinement while initiating deformation of the plate against a generally semicylindrical surface having a length equal at most to one half the length of the plate and a radius substantially equal to the radius of the sleeve to be formed; and continuing the feeding and deformation of the plate until the plate has fully emerged from its confinement and the opposite end edges thereof are substantially contiguous so as to form the cylindrical sleeve.

5. The method as defined in claim 4 including the step of deforming the plate while it is confined in a direction opposite to the deformation effected as the plate emerges from its confinement.

6. The method as defined in claim 5 wherein the deformation of the plate while it is confined is effected at a distance from the region of emergence from confinement which is greater than the length of the plate.

7. The method as defined in claim 6 including the step of deforming the plate into flat form before it emerges from its confinement.

8. The method of forming a sleeve having a circular cross section from a plate having opposite side surfaces and opposite end edges defining a predetermined length of the plate therebetween, which comprises the steps of:

feeding the plate lengthwise while guiding the plate adjacent its opposite side surfaces so that one end edge is in leading relation to the other end edge;

discontinuing the guiding effected adjacent one of said side surfaces while initiating deformation of the plate into final form by continuing the guiding adjacent the other side surface tangentially along an arcuate path which is at most one half the length of the plate and has a radius substantially equal to the radius of the sleeve to be formed; and continuing the feeding and deformation of the plate to issue the one end edge beyond the arcuarate path until such one end edge is in substantially contiguous relation to the other end edge and the sleeve of circular cross-section has been formed.

9. The method as defined in claim 8, including the step of feeding a succession of plates to form a succession of sleeves, the feeding of each plate being effected by a succeeding plate.

* * * * *